US007891960B2

(12) United States Patent
Lea, Jr.

(10) Patent No.: US 7,891,960 B2
(45) Date of Patent: Feb. 22, 2011

(54) RECIPROCAL PUMP FOR GAS AND LIQUIDS

(76) Inventor: James F. Lea, Jr., 4613 94th St., Lubbock, TX (US) 79424

( * ) Notice: Subject to any disclaimer, the term of this patent is extended or adjusted under 35 U.S.C. 154(b) by 792 days.

(21) Appl. No.: 11/685,633

(22) Filed: Mar. 13, 2007

(65) Prior Publication Data

US 2007/0253848 A1 Nov. 1, 2007

Related U.S. Application Data

(60) Provisional application No. 60/781,857, filed on Mar. 13, 2006.

(51) Int. Cl.
*F04B 39/10* (2006.01)

(52) U.S. Cl. ..... 417/555.2; 417/555.1; 417/552; 417/56

(58) Field of Classification Search ..... 417/555.1, 417/555.2, 552, 56–60, 546, 547, 554; 166/105.5, 166/241.2

See application file for complete search history.

(56) References Cited

U.S. PATENT DOCUMENTS

| | | | |
|---|---|---|---|
| 1,578,720 | A | 3/1926 | Derby |
| 2,910,002 | A | 10/1959 | Morgan |
| 3,483,827 | A | 12/1969 | Hooper |
| 3,594,103 | A | 7/1971 | Hillis |
| 3,861,471 | A | 1/1975 | Douglas |
| 3,887,008 | A | 6/1975 | Canfield |
| 4,293,287 | A | 10/1981 | Carrens |
| 4,531,593 | A | 7/1985 | Elliott et al. |
| 4,557,668 | A | 12/1985 | Jones |
| 4,643,258 | A | 2/1987 | Kime |
| 4,673,338 | A | 6/1987 | Jones |
| 4,880,363 | A | 11/1989 | Holland |
| 4,968,226 | A | 11/1990 | Brewer |
| 5,391,057 | A | 2/1995 | Bryce et al. |
| 5,450,901 | A | 9/1995 | Ellwood |
| 5,605,193 | A | 2/1997 | Bearden et al. |
| 5,915,475 | A | 6/1999 | Wells et al. |

(Continued)

FOREIGN PATENT DOCUMENTS

| | | |
|---|---|---|
| CA | 1023656 | 1/1978 |

(Continued)

*Primary Examiner*—Devon C Kramer
*Assistant Examiner*—Christopher Bobish
(74) *Attorney, Agent, or Firm*—Fellers, Snider, Blankenship, Bailey & Tippens, P.C.

(57) ABSTRACT

A pump for efficiently producing gas in wells having some liquids. The pump may be driven by a walking beam or horsehead pump. The pump of the invention produces gases and liquids separately. Gases may be produced up the annulus between the casing and hollow sucker rods. A plunger seals the opening in the cage during downstroke. Gases and liquids are trapped in the cage above an inner barrel. Liquids are forced up the hollow sucker rod where they are retained by a one-way valve. On the upstroke, the one-way valve seats and gases are forced out of the cage and up the annulus. Gases are, therefore, produced up the annulus and liquids are produced up the drill string. In another embodiment, liquids are retained in a trap and are produced up hollow sucker rods, while gases are produced up the annulus between the hollow sucker rods and the casing.

30 Claims, 5 Drawing Sheets

U.S. PATENT DOCUMENTS

| | | | |
|---|---|---|---|
| 6,142,224 | A | 11/2000 | Stuebinger et al. |
| 6,164,376 | A | 12/2000 | Stuebinger et al. |
| 6,182,751 | B1 | 2/2001 | Koshkin et al. |
| 6,273,690 | B1 | 8/2001 | Fischer, Jr. et al. |
| 6,357,530 | B1 | 3/2002 | Kennedy et al. |
| 6,830,441 | B1 | 12/2004 | Williams |
| 6,945,762 | B2 | 9/2005 | Williams |
| 2004/0020638 | A1 | 2/2004 | Williams |
| 2004/0060705 | A1 | 4/2004 | Kelley |
| 2005/0226752 | A1 | 10/2005 | Brown |
| 2006/0002808 | A1 | 1/2006 | Williams |

FOREIGN PATENT DOCUMENTS

| | | |
|---|---|---|
| GB | 2302892 | 2/1997 |

RECIPROCAL PUMP FOR GAS AND LIQUIDS

CROSS REFERENCE TO RELATED APPLICATIONS

This application claims the benefit of U.S. Provisional Patent Application No. 60/781,857, filed Mar. 13, 2006, entitled "Reciprocal Pump for Gas and Liquids," which application is incorporated herein by reference.

FIELD OF THE INVENTION

A pump that efficiently produces gas in wells having some liquids. More particularly, the pump of the invention is a reciprocating pump that produces gases and liquids separately.

BACKGROUND OF THE INVENTION

As energy needs become more pressing and the price of natural gas rises, it will become economically feasible and desirable to conserve and utilize natural gas from oil wells, including substantially depleted oil wells. One problem with wells that produce gas and some liquids is that when liquids accumulate in pumps designed to produce gas, the liquids put a heavy load on the pumps.

SUMMARY

Therefore, it is desirable to provide a pump that is designed to efficiently produce gas in wells having some liquids. Preferably, the pump will be driven by common existing equipment, such as an existing walking beam or horsehead pump. The described pump produces gases and liquids separately.

In one embodiment, gases are produced up the annulus between the casing and the hollow sucker rods. A plunger seals the opening in the cage during downstroke. Gases and liquids are trapped in the cage above an inner barrel. Liquids are forced up the hollow sucker rod where they are retained by a one-way valve. On the upstroke, the one-way valve seats and gases are forced out of the cage and up the annulus. In this way, gases are produced up the annulus and liquids are produced up the drill string.

In another embodiment, liquids are retained in a trap and are similarly produced up the hollow sucker rods, while gases are produced up the annulus between the hollow sucker rods and the casing.

A well that utilizes the first above described embodiment utilizes a reciprocating pump for efficiently pumping both gas and liquids. An outer barrel is secured to an inside of the casing. The outer barrel defines a central orifice/gas port on an upper end. Hollow sucker rods, e.g., a tubing string, extends into the casing and pass through the central orifice/gas port on the upper end of the outer barrel. A sliding seal is affixed to an exterior of the hollow sucker rods for selective engagement with the central orifice/gas port on the outer barrel. A one way liquid valve is provided in the hollow sucker rods. An inner barrel is received within the outer barrel. The inner barrel has a shoulder seal section affixed to a lower end of the hollow sucker rods. The inner barrel further defines a chamber having an upper surface and a lower surface. The upper surface of the chamber defines an output gas port. The lower surface of the chamber defines an intake port selectively closed by a one way valve, e.g., by a ball and seat valve or other suitable valve, wherein the intake port one way valve opens during downstroke and closes during upstroke;

When the hollow sucker rods are stroked in a downward direction, the inner barrel is moved downwardly with respect to the outer barrel, and the intake one way valve opens to allow liquid and gas to enter the chamber through the intake port. Liquid and gas pass through the output gas port on the upper surface of the chamber. The sliding seal sealingly engages an upper end of the outer barrel for sealing the central orifice/gas port defined by the outer barrel. The liquid in the chamber is forced into the hollow sucker rods and through the one way valve on the hollow sucker rods.

When the hollow sucker rod is stroked in an upward direction, the inner barrel is moved upwardly with respect to the outer barrel. The intake one way valve closes to prevent gas and liquid from escaping through the intake port. The sliding seal then disengages from the central orifice/gas port on an upper end of the outer barrel to allow gas to escape into the casing annulus. The shoulder seal engages the central orifice/gas port to prevent further liquids and gases from escaping through the central orifice/gas port.

A well utilizing the second above described embodiment utilizes a reciprocating pump for efficiently pumping both gas and liquids. The well includes an outer barrel secured to an inside of the casing. The outer barrel defines a central orifice/gas port on an upper end.

An inner barrel is received within the outer barrel. The inner barrel defines a central orifice on an upper end and further defines a chamber having an upper surface and a lower surface.

A liquid trap collects fluid draining from within the chamber. The upper surface of the chamber defines an output port. The lower surface of the chamber defines an intake port selectively closed by a one way valve, such as a ball and seat valve.

Hollow sucker rods extend into the casing and pass through the central orifice/gas port on the outer barrel. A one way liquid valve is located in the hollow sucker rods. A plunger is provided on a lower end of the hollow sucker rods for sealingly engaging an inner surface of the liquid trap. A sliding seal is affixed to an exterior of the hollow sucker rods for engaging the central orifice/gas port on the outer barrel during a lower portion of a stroke of the hollow sucker rods.

When the hollow sucker rods are stroked in a downward direction, the inner barrel is moved downwardly with respect to the outer barrel. The intake port one way valve opens to allow liquid and gas to enter the chamber through the intake port, and allows the liquid and gas to pass through the output port on the upper surface of the chamber. The sliding seal sealingly engages an upper end of the outer barrel for sealing the central orifice/gas port defined by the outer barrel. The liquid in the liquid trap is forced into the hollow sucker rods and through the one way liquid valve on the hollow sucker rods.

When the hollow sucker rods are stroked in an upward direction, the inner barrel is moved upwardly with respect to the outer barrel. The intake port one way valve closes to prevent gas and liquid from escaping through the intake port. The plunger disengages from the liquid trap to allow liquid in the chamber to drain into the liquid trap. And the sliding seal disengages from the orifice/gas port on an upper end of the outer barrel to allow gas to escape into the casing annulus.

DESCRIPTION OF THE PREFERRED EMBODIMENTS

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1A:
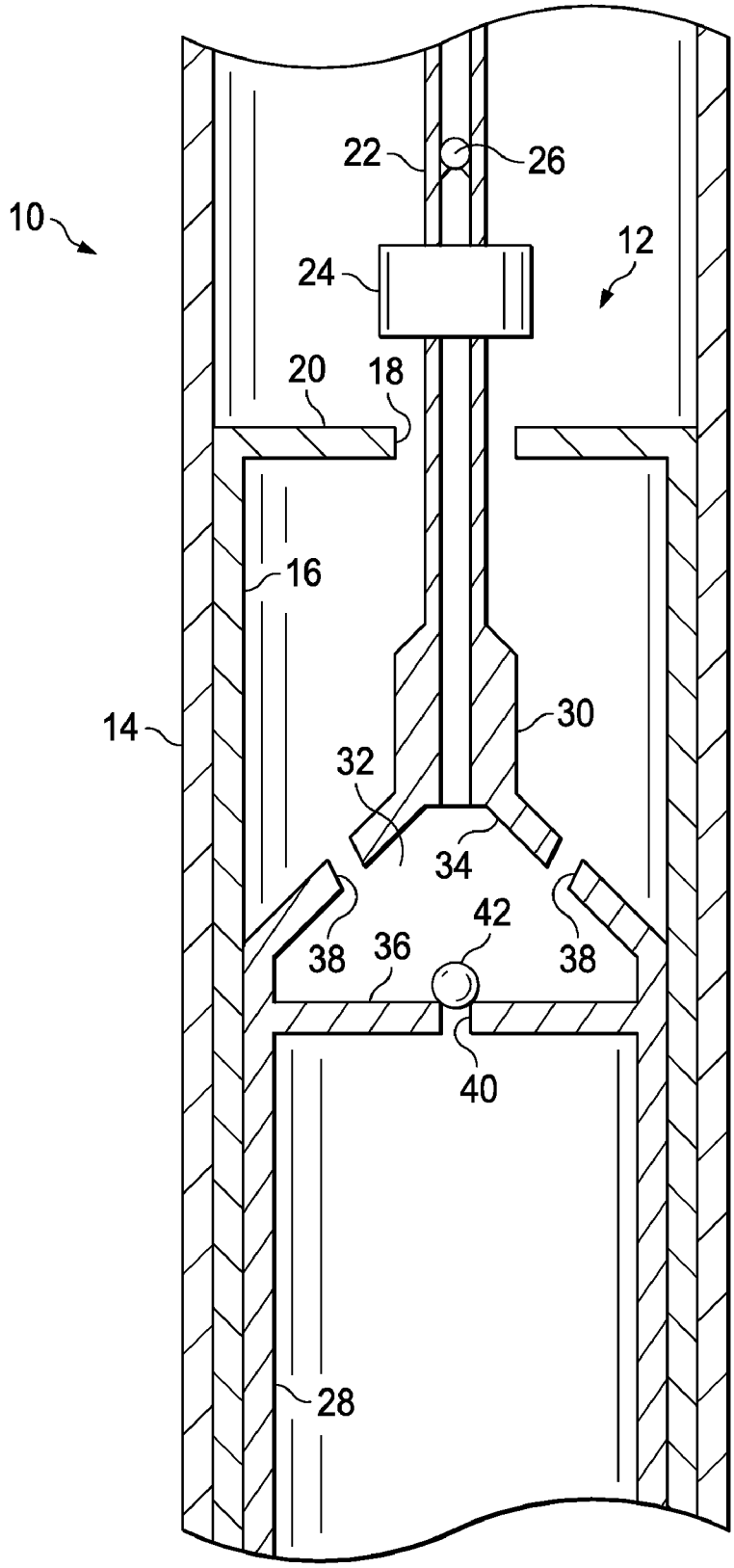
FIG. 1*a* is a cross-sectional view of a well having a first embodiment of a reciprocal pump for producing gas and liquids, showing the pump at mid-stroke on the downstroke.
Figure 1B:
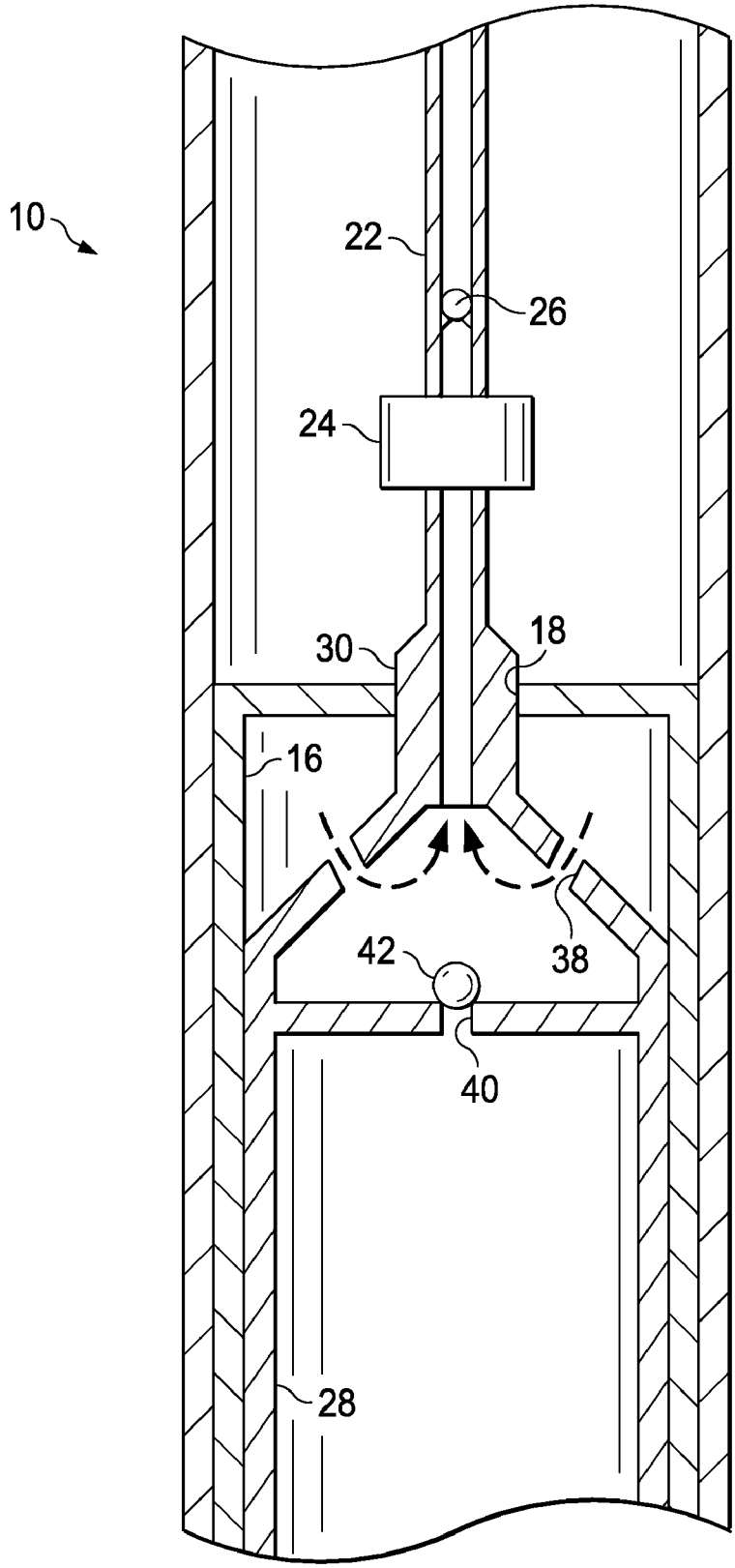
FIG. 1*b* is a cross-sectional view of a well showing the pump of FIG. 1*a* during upstroke as the pump approaches an uppermost position.
Figure 1C:
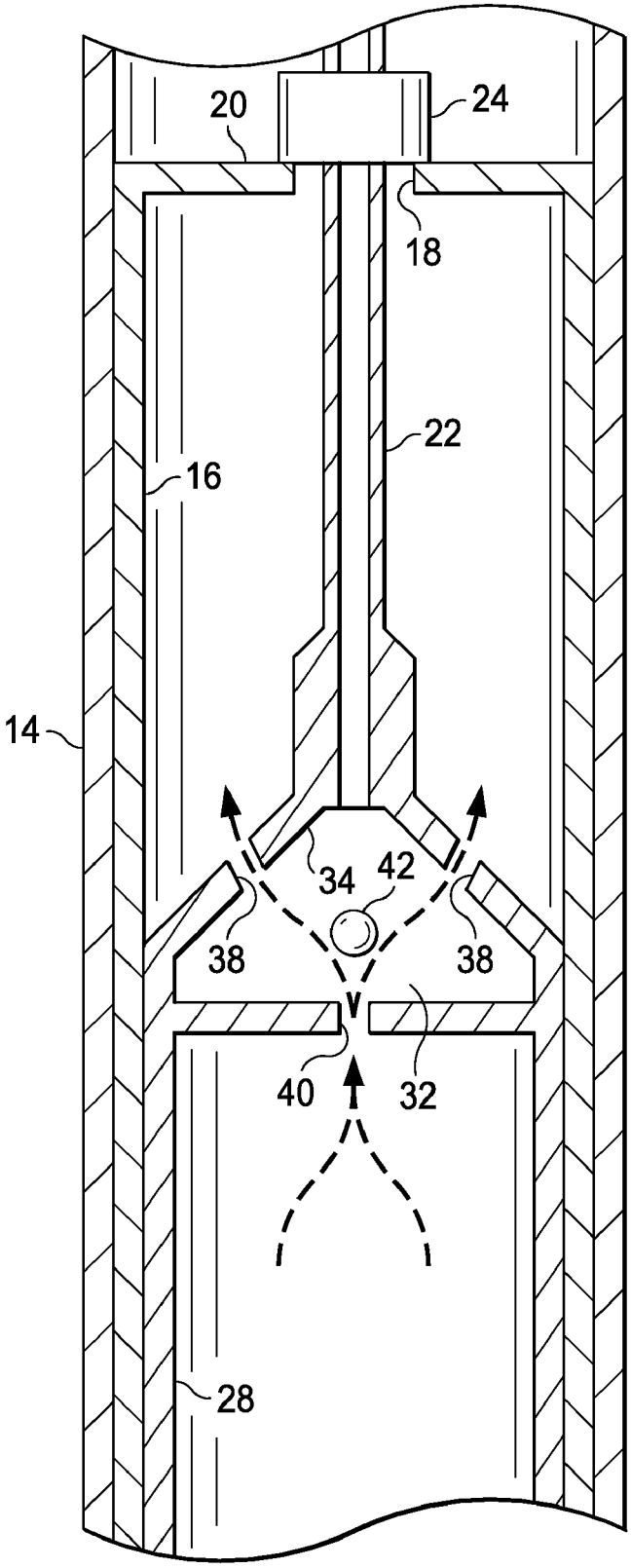
FIG. 1*c* is a cross-sectional view of a well showing the pump of FIG. 1*a* during downstroke as the pump approaches a lowermost position.

Referring now to FIGS. 1*a-c*, well 10 is shown utilizing a first embodiment 12 of a reciprocating pump for efficiently pumping both gas and liquids. Well 10 includes well casing 14. Outer barrel 16 is secured to an inside surface of casing 14. Although this description utilizes the term "well case" or "casing" throughout, it should be understood that casing refers not only to well casing as the term is typically understood in the art, but also to any large tubing within which the pump of the invention may be deployed. Outer barrel 16 has an upper end 20 that defines a central orifice/gas port 18. Hollow sucker rods 22, e.g., a tubing string or a coiled tubing string acting as sucker rods and flow path extends into casing 14 and passes through central orifice/gas port 18 on upper end 20 of outer barrel 16. A sliding seal 24 is affixed to an exterior of said hollow sucker rods 22 for selective engagement with central orifice/gas port 18 on outer barrel 16. One-way liquid valve 26 is provided in said hollow sucker rods 22.

Inner barrel 28 is received within outer barrel 16. Inner barrel 28 has a shoulder seal section 30 that is affixed to a lower end of hollow sucker rods 22. Inner barrel 28 further defines a chamber 32 having an upper surface 34 and a lower surface 36. Upper surface 34 of chamber 32 defines an output gas port 38. Lower surface 36 of chamber 32 defines an intake port 40 selectively closed by one-way valve 42, e.g. check valve or ball and seat. Intake port one-way valve 42 opens during downstroke and closes during upstroke.

Figure 2A:
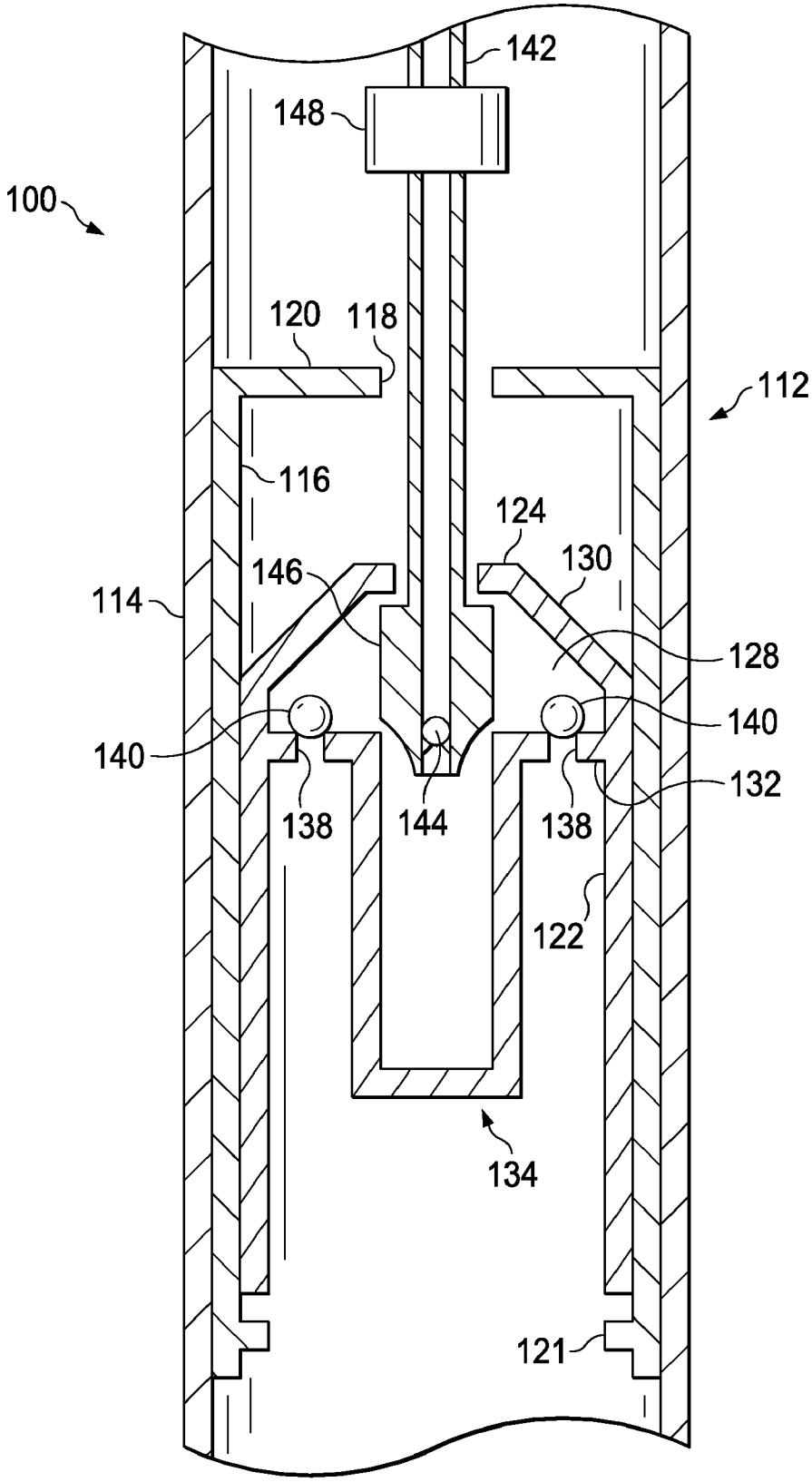
FIG. 2*a* is a cross-sectional view of a well having a second embodiment of a reciprocal pump for producing gas and liquids, showing the pump during upstroke as the pump approaches an uppermost position.
Figure 2B:
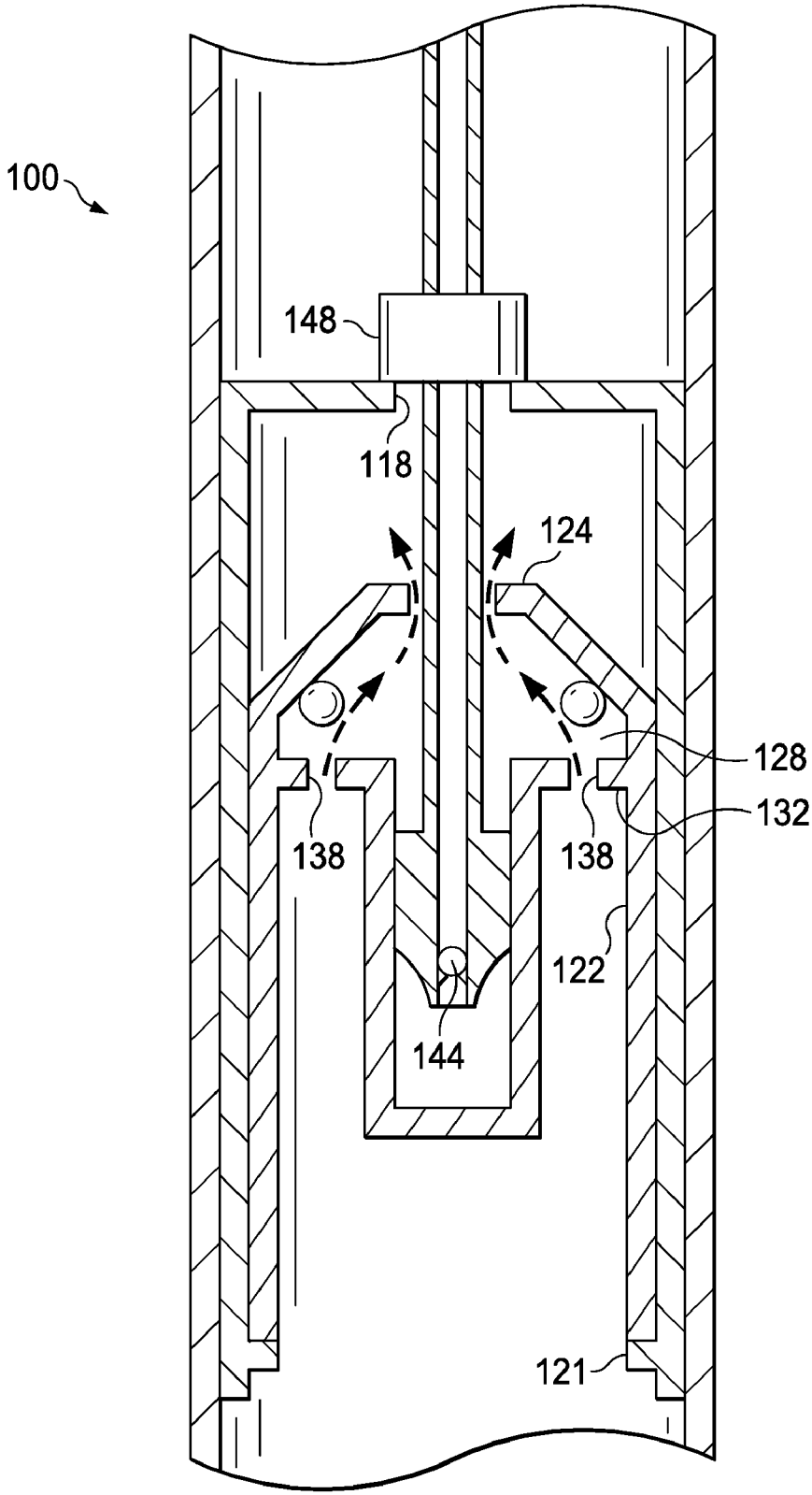
FIG. 2*b* is a cross-sectional view of a well showing the pump of FIG. 2*a* during downstroke as the pump approaches a lowermost position.

Referring now to FIGS. 2*a-b*, shown is a well 100 for utilizing a second embodiment 112 of a reciprocating pump for efficiently pumping both gas and liquids. Well 100 utilizes well casing 114. Outer barrel 116 is secured to an inside surface of casing 114. Outer barrel 116 has upper end 120 that defines a central orifice/gas port 118.

An inner barrel 122 is received within outer barrel 116. Inner barrel 122 has an upper end 120 that defines a central orifice 124. Inner barrel 122 further defines a chamber 128 having an upper surface 130 and a lower surface 132. Liquid trap 134 is provided for collecting fluid from within said chamber 129. Upper surface 130 of chamber 128 defines an output port 136. Lower surface 132 of chamber 128 defines an intake port 138 selectively closed by a one-way valve 140, such as a ball and seat valve.

Hollow sucker rods 142 extends into casing 114 and passes through central orifice/gas port 118 on outer barrel 116. One-way liquid valve 144, e.g., a check valve or a ball and seat valve, is provided in hollow sucker rods 142. Plunger 146 is located on a lower end of hollow sucker rods 142 for sealingly engaging an inner surface of liquid trap 134. Sliding seal 148 is affixed to an exterior of said hollow sucker rods 142 for engaging central orifice/gas port 118 on outer barrel 116 during a lower portion of a stroke of said hollow sucker rods 142.

In use, embodiment 12, shown in FIGS. 1*a-c*, operates as follows. Referring first to FIG. 1*c*, shown is a first embodiment 10 of the reciprocal pump of the invention during downstroke as pump 10 approaches a lowermost position. As hollow sucker rods 22 is stroked in a downward direction, inner barrel 28 is moved downwardly with respect to said outer barrel 16. Intake one-way valve 42 lifts off of intake port 40 to allow liquid and gas to enter chamber 32. The liquid and gas fill chamber 32 and pass through output gas port 38 on upper surface 36 of chamber 32 into a space defined by hollow sucker rods 22, outer barrel 16 and upper end 20. During mid-stroke (FIG. 1*a*) gas is free to escape through orifice/gas port 18 into the casing annulus. As hollow sucker rods 22 and attached inner barrel 28 move downwardly, sliding seal 24 sealingly engages upper end 20 of said outer barrel 16 for sealing said central orifice/gas port 18.

Referring now primarily to FIG. 1*b*, first embodiment 10 of the reciprocal pump of the invention is shown during upstroke as pump 10 approaches an uppermost position. As hollow sucker rods 22 is stroked in an upward direction, inner barrel 28 is moved upwardly with respect to outer barrel 16. Intake one-way valve 42 seats on intake port 40 to prevent liquid from escaping from chamber 32 through intake port 40. As hollow sucker rods 22 and inner barrel 28 move upwards, sliding seal 24 lifts off of orifice/gas port 18. As hollow sucker rods 22 and inner barrel 28 continue to move upwards the area defined by hollow sucker rods 22, outer barrel 16 and upper end 20 is reduced in size, which forces gas through orifice/gas port 18, as upper surface 34 of chamber 32 approaches upper end 20 of outer barrel 16. As pump 10 approaches an uppermost position, shoulder seal section 30 on hollow sucker rods 22 forms a seal with orifice/gas port 18. As hollow sucker rods 22 and attached inner barrel 28 travel though the last portion of the upstroke, liquid is forced back through output gas ports 38 on upper surface 34 of chamber 32 and upwards into the interior of hollow sucker rods 22. As liquid passes upwardly through hollow sucker rods 22, the liquid passes through one-way liquid valve 26, such as a ball and seat valve. A preferred condition for operation of the pump of the invention is operation in a well having mostly gas with some associated liquids.

A subsequent downstroke of pump 10 results in closure of one-way liquid valve 26 so that any liquids previously forced through one-way liquid valve 26 remain above the valve for production.

Therefore, it can be seen that pump 12 of the invention is uniquely suited to produce large volumes of gas while simultaneously producing some associated liquids.

One advantage associated with first embodiment 10 is that weight or pressure from the liquid column does not act on lower surface 36 and the attached hollow sucker rods 22 until near the top of the stroke and not at all if there is no liquids to be produced on any individual stroke.

Referring now to FIGS. 2*a* and *b*, second embodiment 112 of the reciprocal pump of the invention is shown. FIG. 2*b* shows second embodiment 112 during downstroke as pump 112 approaches a lowermost position. As hollow sucker rods 142 are stroked in a downward direction, plunger 146 is moved downwardly with respect to inner barrel 122 into liquid trap 134. As plunger 146 moves towards the bottom of liquid trap 134, any liquid located within the liquid trap 134 is forced into hollow sucker rods 142 and through one-way liquid valve 144, such as a ball and seat valve. As hollow sucker rods 142 continues to move downwardly, plunger 146 will engage a bottom of liquid trap 134 and force inner barrel 122 to move downwardly with respect to outer barrel 116. As hollow sucker rods 142 and attached inner barrel 122 move downwardly, sliding seal 148 sealingly engages upper end 120 of said outer barrel 116 for sealing said central orifice/gas port 118 and intake one-way valves 140 lift off of intake ports 138 to allow liquid and gas to enter chamber 128. Liquid and gas fill chamber 128. The liquid and gas are free to pass through central orifice 124 on upper surface 130 of chamber 128 and into a space defined by hollow sucker rods 142, outer barrel 116 and upper end 120. A stop 121 is provided below outer barrel 116 to stop inner barrel 122 on bottom of downstroke. Stop 121 may be attached to outer barrel 116 (FIGS. 2*a*, 2*b*) or fixed to casing 114.

Referring now to FIG. 2*a*, shown is second embodiment 112 of the reciprocal pump of the invention during upstroke as pump 12 approaches an uppermost position. As hollow sucker rods 142 are stroked in an upward direction, plunger 146 is moved upwardly with respect to inner barrel 122 and liquid trap 134. As plunger 146 moves out of liquid trap 134 and towards the upper surface 132 of chamber 128, any liquid located within chamber 128 is free to flow out of chamber 128 and into liquid trap 134. As hollow sucker rods 142 continues to move upwardly, plunger 146 will engage upper surface 132 of chamber 128 and force attached inner barrel 122 to move upwardly with respect to outer barrel 116. As hollow sucker rods 142 and attached inner barrel 122 move upwardly, sliding seal 148 lifts off of upper end 120 of said outer barrel 116 and unseals central orifice/gas port 118 to allow gas to pass through central orifice/gas port 118 into the casing annulus. Intake one-way valves 140 seat in intake ports 138 to prevent liquid and gas from exiting chamber 128 through intake port 138. Instead, liquid trapped in chamber 128 collects in liquid trap 134.

On a subsequent downstroke, plunger 146 forces the liquid in liquid trap 134 into hollow sucker rods 142. Therefore, it can be seen that valve 112 of the invention is uniquely suited to produce large volumes of gas while simultaneously producing liquids.

One advantage associated with second embodiment 100 is that the weight and pressure from the liquid column acting on upper surface 130 and carried by a higher load on hollow sucker rods 142 as long as liquid does not exceed the trap volume 134 and as such the pump might be sized to the well as one technique to consider various gas/liquid ratios and liquid volumes.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A well for utilizing a reciprocating pump for efficiently pumping both gas and liquids, comprising: well casing; an outer barrel secured to an inside of said casing, said outer barrel defining a central orifice/gas port on an upper end; an inner barrel received within said outer barrel, said inner barrel further defining a chamber having an upper surface and a lower surface; a tubing string extending into said casing and passing through said central orifice/gas port defined by said outer barrel; a sliding seal affixed to an exterior of said tubing string for engagement with said central orifice/gas port defined by said outer barrel; a one way liquid valve in said tubing string; wherein said upper surface of said chamber defines an output gas port; wherein said lower surface of said chamber defines an intake port selectively closed by an intake port one way valve; and wherein liquids are produced to a ground surface entirely through said tubing string while gas is produced through an annulus that surrounds said tubing string.

2. The well according to claim 1 wherein:

said inner barrel has a shoulder seal section affixed to a lower end of said tubing string such that said shoulder seal is linearly displaced by an amount equal to a linear displacement of said tubing string during an upstroke and a downstroke of said tubing string.

3. The well according to claim 1 wherein:

said tubing string passes through an upper end of said outer barrel.

4. The well according to claim 1 wherein:

said sliding seal engages said central orifice/gas port during a lower portion of a stroke of said tubing string.

5. A well for utilizing a reciprocating pump for effectively pumping both gas and liquids, comprising:

well casing;

an outer barrel secured to an inside of said casing, said outer barrel defining a central orifice/gas port on an upper end;

an inner barrel received within said outer barrel, said inner barrel further defining a chamber having an upper surface and a lower surface;

a tubing string extending into said casing and passing through said central orifice/gas port defined by said outer barrel;

a sliding seal affixed to an exterior of said tubing string for engagement with said central orifice/gas port defined by said outer barrel;

a one way liquid valve in said tubing string;

wherein said upper surface of said chamber defines an output gas port;

wherein said lower surface of said chamber defines an intake port selectively closed by an intake port one way valve;

wherein liquids are produced through said tubing string while gas is produced through an annulus that surrounds said tubing string; and wherein said intake port one way valve for selectively closing said intake port opens during downstroke and closes during upstroke of said tubing string.

6. The well according to claim 1 wherein:

said intake port one way valve is a ball and seat valve.

7. A well for utilizing a reciprocating pump for efficiently pumping both gas and liquids, comprising:

well casing;

an outer barrel secured to an inside of said casing, said outer barrel defining a central orifice/gas port on an upper end;

an inner barrel received within said out barrel, said inner barrel further defining a chamber having an upper surface and a lower surface;

a tubing string extending into said casing and passing through said central orifice/gas port defined by said outer barrel;

a sliding seal affixed to an exterior or said tubing string for engagement with said central orifice/gas port defined by said outer barrel;

a one way liquid valve in said tubing string;

wherein said upper surface of said chamber defines an output gas port;

wherein said lower surface of said chamber defines an intake port selectively closed by an intake port one way valve;

wherein liquids are produced through said tubing string while gas is produced through an annulus that surrounds said tubing string; and wherein when said tubing string is stroked in a downward direction, said inner barrel is moved downwardly with respect to said outer barrel, said intake port one way valve opens to allow liquid and gas to enter said chamber through said intake port, and allows said liquid and gas to pass through said output gas port on said upper surface of said chamber, and wherein said sliding seal sealingly engages said upper end of said outer barrel for sealing said central orifice/gas port defined by said outer barrel, and said liquid in said chamber is forced into said tubing string and through said one way liquid valve on said tubing string.

8. A well for utilizing a reciprocating pump for efficiently pumping both gas and liquids, comprising:

well casing;

an outer barrel secured to an inside of said casing, said outer barrel defining a central orifice/gas port on an upper end;

an inner barrel received within said outer barrel, said inner barrel further defining a chamber having an upper surface and a lower surface;

a tubing string extending into said casing and passing through said central orifice/gas port defined by said outer barrel;

a sliding seal affixed to an exterior of said tubing string for engagement with said central orifice/gas port defined by said outer barrel;

a one way liquid valve in said tubing string;

wherein said upper surface of said chamber defines an output gas port;

wherein said lower surface of said chamber defines an intake port selectively closed by an intake port one way valve;

wherein liquids are produced through said tubing string while gas is produced through an annulus that surrounds said tubing string;

an expanded portion of said tubing string having a greater diameter than said central orifice/gas port and located within said outer barrel; and wherein when said tubing string is stroked in an upward direction, said inner barrel is moved upwardly with respect to said outer barrel, said intake port one way valve closes to prevent gas and liquid from escaping through said intake port, said sliding seal disengages from said central orifice/gas port on an upper end of said outer barrel to allow gas to escape into a casing annulus defined by an outside surface of said tubing string and an inside surface of said casing, said expanded portion defining a shoulder seal that engages said central orifice/gas port to prevent further liquids and gases from escaping through said central orifice/gas port.

9. A well for utilizing a reciprocating pump for efficiently pumping both gas and liquids, comprising:

well casing;

an outer barrel secured to an inside of said casing, said outer barrel defining a central orifice/gas port on an upper end;

a tubing string extending into said casing and passing through said central orifice/gas port defined by said upper end of said outer barrel;

a sliding seal affixed to an exterior of said tubing string for selective engagement with said central orifice/gas port defined by said outer barrel;

a one way liquid valve in said tubing string;

an inner barrel received within said outer barrel, said inner barrel having a shoulder seal section affixed to a lower end of said tubing string, said inner barrel further defining a chamber having an upper surface and a lower surface;

wherein said upper surface of said chamber defines an output gas port;

wherein said lower surface of said chamber defines an intake port selectively closed by an intake port one way valve, wherein said intake port one way valve opens during downstroke and closes during upstroke;

wherein when said tubing string is stroked in a downward direction, said inner barrel is moved downwardly with respect to said outer barrel, said intake port one way valve opens to allow liquid and gas to enter said chamber through said intake port, which allows said liquid and gas to pass through said output gas port defined by said upper surface of said chamber, and wherein said sliding seal sealingly engages said upper end of said outer barrel for sealing said central orifice/gas port defined by said outer barrel, and wherein said liquid in said chamber is forced into said tubing string and through said one way liquid valve on said tubing string;

wherein when said tubing string is stroked in an upward direction, said inner barrel is moved upwardly with respect to said outer barrel, said intake port one way valve closes to prevent gas and liquid from escaping through said intake port, said sliding seal disengages from said central orifice/gas port on said upper end of said outer barrel to allow gas to escape into a casing annulus defined by an outside surface of said tubing string and an inside surface of said casing;

and wherein a shoulder seal on a lower end of said tubing string engages said central orifice/gas port to prevent further liquids and gases from escaping through said central orifice/gas port.

10. The well according to claim 1 wherein:

said sliding seal is slidably affixed to an exterior of said tubing string for intermittent engagement with said central orifice/gas port defined by said outer barrel.

11. The well according to claim 1 wherein:

an outside surface of said outer barrel is mounted flush against an inside surface of said casing.

12. A well for utilizing a reciprocating pump for efficiently pumping both gas and liquids, comprising:

well casing;

an outer barrel secured to an inside of said casing, said outer barrel defining a central orifice/gas port on an upper end;

an inner barrel received within said outer barrel, said inner barrel further defining a chamber having an upper surface and a lower surface;

a tubing string extending into said casing and passing through said central orifice/gas port defined by said outer barrel;

a sliding seal is slidably affixed to an exterior of said tubing string for intermittent engagement with said central orifice/gas port defined by said outer barrel;

a one way liquid valve in said tubing string;

wherein said upper surface of said chamber defines an output gas port;

wherein said lower surface of said chamber defines an intake port selectively closed by an intake port one way valve; and wherein liquids are produced through said tubing string while gas is produced through an annulus that surrounds said tubing string.

13. The well according to claim 12 wherein:

said inner barrel has a shoulder seal section affixed to a lower end of said tubing string such that said shoulder seal is linearly displaced by an amount equal to a linear displacement of said tubing string.

14. The well according to claim 12 wherein:

wherein said intake port one way valve for selectively closing said intake port opens during downstroke and closes during upstroke of said tubing string.

15. The well according to claim 12 wherein:

an expanded portion of said tubing string having a greater diameter than said central orifice/gas port and located within said outer barrel; and when said tubing string is stroked in an upward direction, said inner barrel is moved upwardly with respect to said outer barrel, said intake port one way valve closes to prevent gas and liquid from escaping through said intake port, said sliding seal disengages from said central orifice/gas port on an upper end of said outer barrel to allow gas to escape into a casing annulus defined by an outside surface of said tubing string and an inside surface of said casing, said expanded portion defining a shoulder seal that engages said central orifice/gas port to prevent further liquids and gases from escaping through said central orifice/gas port.

16. The well according to claim 12 wherein:

when said tubing string is stroked in a downward direction, said inner barrel is moved downwardly with respect to said outer barrel, said intake port one way valve opens to allow liquid and gas to enter said chamber through said intake port, and allows said liquid and gas to pass through said output gas port on said upper surface of said chamber, and wherein said sliding seal sealingly engages said upper end of said outer barrel for sealing said central orifice/gas port defined by said outer barrel, and said liquid in said chamber is forced into said tubing string and through said one way liquid valve on said tubing string.

17. The well according to claim 12 wherein:

said gas produced through said annulus fills an annular space defined by said tubing string and said casing.

18. The well according to claim 12 wherein:

an outside surface of said outer barrel is mounted flush against an inside surface of said casing.

19. A well for utilizing a reciprocating pump for efficiently pumping both gas and liquids, comprising: well casing; an outer barrel secured to an inside of said casing, said outer barrel defining a central orifice/gas port on an upper end; an inner barrel received within said outer barrel, said inner barrel further defining a chamber having an upper surface and a lower surface; a tubing string extending into said casing and passing through said central orifice/gas port defined by said outer barrel; a sliding seal slidably affixed to an exterior of said tubing string for engagement with said central orifice/gas port defined by said outer barrel; a one way liquid valve in said tubing string; wherein said upper surface of said chamber defines an output gas port; wherein said lower surface of said chamber defines an intake port selectively closed by an intake port one way valve; wherein liquids are produced through said tubing string while gas is produced through an annulus that surrounds said tubing string; and wherein an outside surface of said outer barrel is mounted flush against an inside surface of said casing.

20. The well according to claim 19 wherein:

said inner barrel has a shoulder seal section affixed to a lower end of said tubing string such that said shoulder seal is linearly displaced by an amount equal to a linear displacement of said tubing string.

21. The well according to claim 19 wherein:

wherein said intake port one way valve for selectively closing said intake port opens during downstroke and closes during upstroke of said tubing string.

22. The well according to claim 19 wherein:

an expanded portion of said tubing string having a greater diameter than said central orifice/gas port and located within said outer barrel;

when said tubing string is stroked in an upward direction, said inner barrel is moved upwardly with respect to said outer barrel, said intake port one way valve closes to prevent gas and liquid from escaping through said intake port, said sliding seal disengages from said central orifice/gas port on an upper end of said outer barrel to allow gas to escape into a casing annulus defined by an outside surface of said tubing string and an inside surface of said casing, said expanded portion defining a shoulder seal that engages said central orifice/gas port to prevent further liquids and gases from escaping through said central orifice/gas port.

23. The well according to claim 19 wherein:

when said tubing string is stroked in a downward direction, said inner barrel is moved downwardly with respect to said outer barrel, said intake port one way valve opens to allow liquid and gas to enter said chamber through said intake port, and allows said liquid and gas to pass through said output gas port on said upper surface of said chamber, and wherein said sliding seal sealingly engages said upper end of said outer barrel for sealing said central orifice/gas port defined by said outer barrel, and said liquid in said chamber is forced into said tubing string and through said one way liquid valve on said tubing string.

24. The well according to claim 19 wherein:

said gas produced through said annulus is produced through and may fill an annular space defined by said tubing string and said casing.

25. The well according to claim 19 wherein:

said sliding seal is slidably affixed to an exterior of said tubing string for intermittent engagement with said central orifice/gas port defined by said outer barrel.

26. A well for utilizing a reciprocating pump for efficiently pumping both gas and liquids, comprising: well casing; an outer barrel secured to an inside of said casing, said outer barrel defining a central orifice/gas port on an upper end; an inner barrel received within said outer barrel, said inner barrel further defining a chamber having an upper surface and a lower surface; a tubing string extending into said casing and passing through said central orifice/gas port defined by said outer barrel; a sliding seal affixed to an exterior of said tubing string for engagement with said central orifice/gas port defined by said outer barrel; a one way liquid valve in said tubing string; wherein said upper surface of said chamber defines an output gas port; wherein said lower surface of said chamber defines an intake port selectively closed by an intake port one way valve; and wherein liquids are produced through said tubing string while gas is produced through and fills an annular space defined by said well casing and said tubing string.

27. The well according to claim 26 wherein:

said inner barrel has a shoulder seal section affixed to a lower end of said tubing string such that said shoulder seal is linearly displaced by an amount equal to a linear displacement of said tubing string during an upstroke and a downstroke of said tubing string.

28. The well according to claim 26 wherein said intake port one way valve for selectively closing said intake port opens during downstroke and closes during upstroke of said tubing string.

29. The well according to claim 26 comprising: an expanded portion of said tubing string having a greater diameter than said central orifice/gas port and located within said outer barrel; and wherein when said tubing string is stroked in an upward direction, said inner barrel is moved upwardly with respect to said outer barrel, said intake port one way valve closes to prevent gas and liquid from escaping through said intake port, said sliding seal disengages from said central orifice/gas port on an upper end of said outer barrel to allow gas to escape into a casing annulus defined by an outside surface of said tubing string and an inside surface of said casing, said expanded portion defining a shoulder seal that engages said central orifice/gas port to prevent further liquids and gases from escaping through said central orifice/gas port.

30. The well according to claim 26 wherein: when said tubing string is stroked in a downward direction, said inner barrel is moved downwardly with respect to said outer barrel, said intake port one way valve opens to allow liquid and gas to enter said chamber through said intake port, and allows said liquid and gas to pass through said output gas port on said upper surface of said chamber, and wherein said sliding seal sealingly engages said upper end of said outer barrel for sealing said central orifice/gas port defined by said outer barrel, and said liquid in said chamber is forced into said tubing string and through said one way liquid valve on said tubing string.

* * * * *

UNITED STATES PATENT AND TRADEMARK OFFICE

CERTIFICATE OF CORRECTION

PATENT NO. : 7,891,960 B2
APPLICATION NO. : 11/685633
DATED : February 22, 2011
INVENTOR(S) : Lea, Jr.

It is certified that error appears in the above-identified patent and that said Letters Patent is hereby corrected as shown below:

In column 6, line 26, claim 5, please replace --effectively-- with “efficiently”.

In column 6, line 63, claim 7, please replace --out-- with “outer”.

In column 7, line 1, claim 7, please replace --or-- with “of”.

Signed and Sealed this
Twelfth Day of April, 2011

David J. Kappos

David J. Kappos
*Director of the United States Patent and Trademark Office*